United States Patent [19]

Dawless et al.

[11] 4,440,610

[45] Apr. 3, 1984

[54] MOLTEN SALT BATH FOR ELECTROLYTIC PRODUCTION OF ALUMINUM

[75] Inventors: Robert K. Dawless, Monroeville; Alfred F. LaCamera, Level Green; Chester H. Klingensmith, Leechburg, all of Pa.

[73] Assignee: Aluminum Company of America, Pittsburgh, Pa.

[21] Appl. No.: 423,682

[22] Filed: Sep. 27, 1982

[51] Int. Cl.[3] ..... C25C 3/06

[52] U.S. Cl. ..... 204/67

[58] Field of Search ..... 204/67

[56] References Cited

U.S. PATENT DOCUMENTS

| | | | |
|---|---|---|---|
| 3,755,099 | 8/1973 | Haupin | 204/67 |
| 3,822,195 | 7/1974 | Dell et al. | 204/64 |
| 4,133,727 | 1/1979 | Rogers, Jr. | 204/67 |
| 4,135,994 | 1/1979 | Ishikawa et al. | 204/67 |

FOREIGN PATENT DOCUMENTS

| | | | |
|---|---|---|---|
| 53-116211 | 10/1978 | Japan | 10 D/122 |
| 53-131211 | 11/1978 | Japan | 10 D/122 |

*Primary Examiner*—G. Ozaki
*Assistant Examiner*—Gerard P. Rooney, Jr.
*Attorney, Agent, or Firm*—Andrew Alexander; Brian D. Smith

[57] ABSTRACT

An improved process for the electrolytic production of aluminum by electrolysis of aluminum chloride in a molten salt electrolyte bath. The improved process is characterized by a reduction in solubility of the reduced aluminum metal as well as a smaller metal droplet size permitting closer anode-cathode spacing in the electrolysis cell and a lower electrical resistance. The improvement comprises performing the electrolysis in an electrolyte consisting essentially of from 0.5 to 15 wt. % aluminum chloride, from 0.5 to 40 wt. % of one or more alkaline earth metal chlorides selected from the class consisting of magnesium chloride, barium chloride, strontium chloride and calcium chloride, from 10 to 90 wt. % lithium chloride and the balance sodium chloride.

10 Claims, 2 Drawing Figures

MOLTEN SALT BATH FOR ELECTROLYTIC PRODUCTION OF ALUMINUM

INTRODUCTION

This invention relates to the electrolytic production of metals, and more particularly, it relates to the production of metals by electrolysis of metal chlorides dissolved in a molten salt.

The production of aluminum by the electrolysis of aluminum chloride in an alkali metal chloride melt has been difficult to realize commercially because of numerous technical problems. Among such problems is a progressive deterioration in the operating efficiency of the electrolytic cell, with a marked change in its electrical operating characteristics and diminution of its output of metallic aluminum. Although not fully understood at the present time, it is believed that certain of the problems that have long been extant are attributable to the presence of undesired constituents and finely divided particulate materials in the molten salt bath. The particulate is attracted to the cathode, apparently by electrical forces, where it forms a semi-permeable coating. This coating of oxides or other particulates on the cathode surface operates to inhibit transport of the complex aluminum ion because of its large size-to-charge ratio. In contrast, the alkali metal ions are driven by the electrical potential gradient and, due both to their abundance and a small size-to-charge ratio, easily penetrate the particulate film and are discharged at the cathode. These reduced species, particularly sodium and potassium, enter the graphite (or the like) electrode lattice, with consequent expansion thereof and surface sloughing of the electrode to further add to the particulates present in the system. In this manner, the mobility of aluminum chloride to the cathodic surface by both convection and diffusion is markedly impeded.

Apart from the foregoing, the presence of oxide and hydroxide impurities in the melt also causes detrimental consumption of the carbon anodes. Such impurities are slightly soluble in the melt and are electrolytically decomposed simultaneously with the aluminum chloride. Oxygen released at the anode forms carbon monoxide and carbon dioxide, with attendant consumption of the anodes and undesirable increases in the anode-cathode spacing.

Other problems which can occur in the production of aluminum relate to the baths or electrolytes used for the electrolysis. For example, Ishikawa U.S. Pat. No. 4,135,994 states that the use of $CaCl_2$ or $MgCl_2$ with NaCl instead of LiCl results in a less expensive electrolyte bath with an increased current efficiency reaching about 90 to nearly 100%. However, it has been found that the use of $CaCl_2$ in significant amounts reduces electrical conductivity of the electrolyte which results in greater electrical power consumption per unit of metal produced.

Further, the use of high levels of $CaCl_2$, exceeding 40 wt.%, and depending to some extent on the level of $AlCl_3$, can have the effect of separating the bath or electrolyte into two liquid layers or phases which can create problems such as high voltages within the cell. Thus, it can be seen that there are competing interests from the standpoint of the use of $CaCl_2$. That is, sufficient $CaCl_2$ must be present in such baths to provide a gain in current efficiency and yet $CaCl_2$ must be sufficiently low in order that bath conductivity is not undesirably reduced, and yet the level of $CaCl_2$ must be maintained sufficiently low so that phase separation does not occur.

In Japanese Patent Publications 1978-131, 211 and 1978-116, 211, $CaCl_2$ is used in an $AlCl_3$ electrolyte bath with LiCl instead of NaCl. In the 1978-116 publication, the bath consists of 2-20 wt.% $AlCl_3$, 12-42 wt.% $CaCl_2$ and 38-86 wt.% LiCl. The 1978-131 publication uses the same range of $AlCl_3$ with a slightly lower LiCl range (35-78 wt.%) but uses a combination of $CaCl_2$ with $MgCl_2$ in a range of 20-45 wt.%. Apparently, these publications recognized the problems associated with the use of $CaCl_2$ in an electrolyte bath and attempted to solve them by reintroducing the LiCl component which the aforementioned Ishikawa U.S. Pat. No. 4,135,994 sought to eliminate.

It would be most desirable to use $CaCl_2$ in the bath while mitigating any deleterious effects of such usage.

The present invention provides a salt bath which solves the problems encountered in the prior art and permits the use of $CaCl_2$ without interfering detrimentally with electrical conductivity or without encountering other problems attendant the use of $CaCl_2$.

SUMMARY OF THE INVENTION

An object of this invention is to provide a molten salt bath for the electrolytic production of metals.

Another object of this invention is to provide a molten salt bath for the electrolytic production of aluminum.

A further object of this invention is to provide a molten salt bath for the electrolytic production of metals which includes the use of low levels of $CaCl_2$ or $MgCl_2$ to maintain high current efficiencies and high levels of electrical conductivity.

Yet another object of the invention is to provide a process which will suppress the solubility of aluminum.

Yet a still further object of the invention is to provide an electrolyte bath which will result in the formation of smaller aluminum droplet size thus, permitting closer anode-cathode spacing for increased current efficiencies.

These and other objects will become apparent from an inspection of the drawing, specification and claims.

In accordance with these objects, there is provided an improved process for electrolytic production of aluminum by electrolysis of aluminum chloride in a cell containing a molten salt electrolyte. The process is characterized by a reduction in solubility of the reduced metal, and a smaller metal droplet size permitting closer anode-cathode spacing resulting in reduced cell resistance. The improvement comprises performing the electrolysis in an electrolyte consisting essentially of from 0.5 to 15 wt.% aluminum chloride, from 0.5 to 40 wt.% of an alkaline earth metal chloride selected from the group consisting of calcium, magnesium, barium and strontium, from 10 to 80 or 90 wt.% lithium chloride and up to 80 wt.% sodium chloride.

DETAILED DESCRIPTION OF THE PREFERRED EMBODIMENTS

Figure 2:
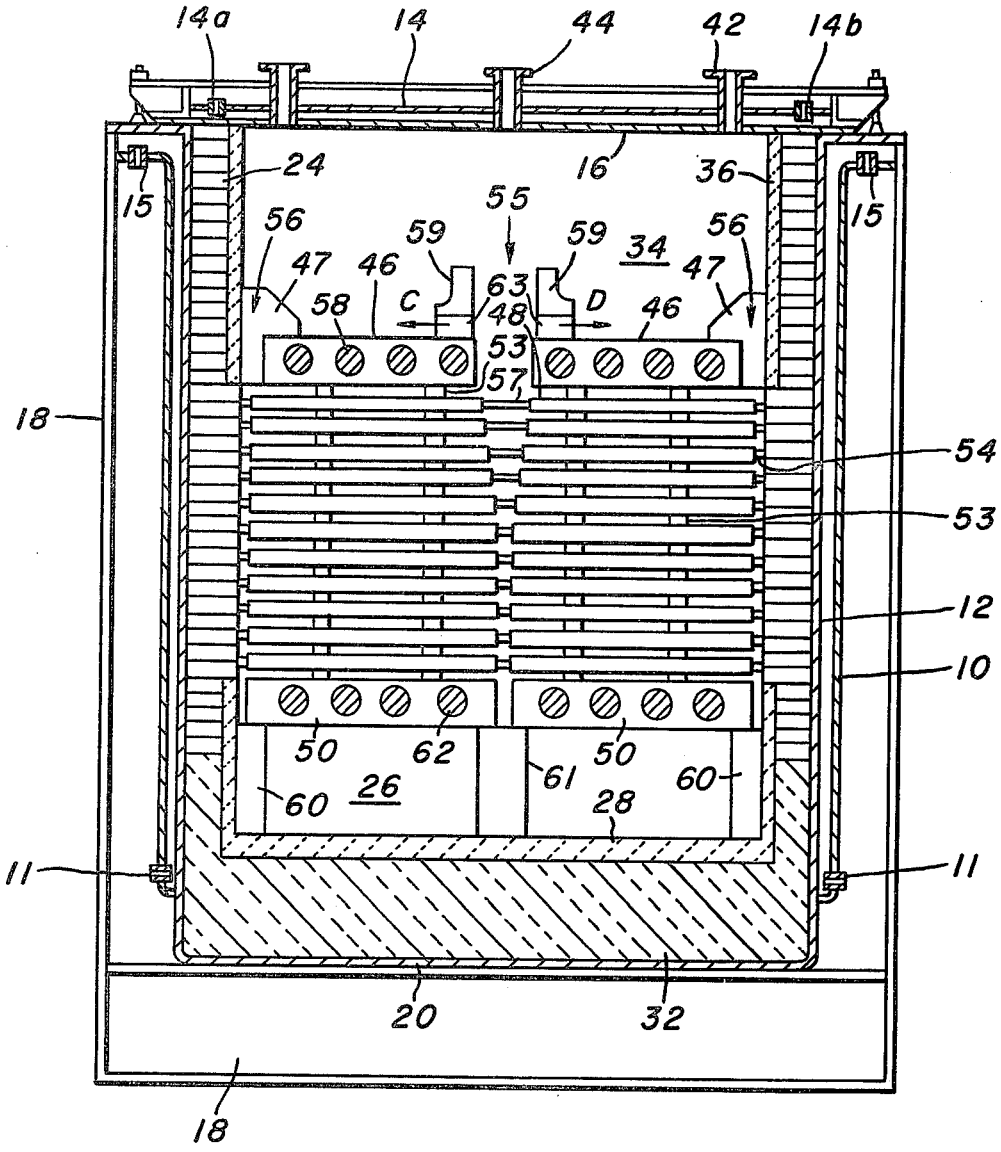
FIG. 2 is a sectional end elevation of a cell suitable for producing metal using a bath in accordance with the invention.

FIG. 2 shows a cell suitable for electrolytically producing aluminum by electrolysis of aluminum chloride dissolved in a molten salt bath in accordance with the present invention.

The cell structure includes an outer steel cooling jacket 10 which surrounds the steel sides 12 of the cell. A cooling fluid (coolant), for example water, flows through jacket 10 for withdrawing heat from the cell. The coolant enters the cooling jacket at coolant inlet ports 11 and is removed at exit nozzles 15. A similar cooling jacket 14, with representative coolant inlet port **14*a* and coolant outlet port 14*b* covers the lid 16 of the cell. Lid 16 is exposed directly to chlorine and salt vapors and is made of a suitably chlorine-resistant metal such as the alloy nominally containing 80% nickel, 15% chromium and 5% iron and sold under the trademark Inconel. All water pipes running to and from the ports of the cooling jackets are provided with rubber hose electrical breaks so that electrical current cannot move to or from the cell along the otherwise metallic pipes. A structural containment 18, for example of steel, encloses and supports the cell and the cooling jacket. In general, it has been found to be good practice to isolate the cell from the floor, for instance by setting containment 18** on an insulating material such as a thermoset plastic material made from fabric or paper impregnated with phenol-formaldehyde resin, for instance the material supplied under the trademark Micarta by Westinghouse Electric Corporation.

The bath containing cell interior surfaces, i.e. those formed by sides 12 and steel bottom 20, are lined with a continuous, corrosion-resistant, electrically insulating lining (not shown) of plastic or rubber material. Good results have been obtained with a lining composed of alternating layers of thermosetting epoxy-based paint and glass fiber cloth. Other plastic or rubber materials are possible. Inwards of the lining a glass barrier can be interposed. The cell is also lined with refractory side wall brick 24 made of thermally insulating, electrically nonconductive, e.g. nitride, material which is resistant to a molten aluminum chloride-containing halide bath and the decomposition products thereof.

An additional lining 36 of graphite is positioned on the side walls alongside and above the anodes 46 to provide further protection against the corrosive influence of the bath and the chlorine gas produced by the operation of the cell. It may be advantageous not to extend this lining 36 right up to lid 16; rather, ending its upward reach short of lid 16 can eliminate a danger of short circuiting.

The cell cavity includes a sump 26 in its lower portion for collecting the aluminum metal produced. The sump is bounded by a tub 28 made of graphite. The upper part of tub 28 extends up alongside the cathodes 50. Tub 28 sits on refractory floor 32 including the glass barrier.

The cell cavity also includes a bath reservoir 34 in its upper zone. A first port, tapping port 38, extending through the lid 16 into bath reservoir 34, provides for insertion of a vacuum tapping tube down into sump 26, through an internal passage for removing molten aluminum. A second port, feeding port 42, provides inlet means for feeding aluminum chloride into the bath. A third port, vent port 44, provides outlet means for venting chlorine. During cell operation, port 38 may have vacuum tapping apparatus associated with it while port 42 will have a feeder mechanism attached to it, and port 44 will be connected to a pipeline for carrying away the chlorine-rich effluent.

Within the cell cavity are a plurality of plate-like electrodes divided up into two stacks. In the direction perpendicular to the plane of FIG. 1, in which direction the depth of the electrodes lie, the electrodes extend such that they abut against the lining of the cell. Each stack includes an upper anode 46, desirably an appreciable number of bipolar electrodes 48 (11 being shown), and a lower cathode 50, all being made, for example, of graphite. These electrodes are arranged in superimposed, spaced relationship defining a series of interelectrode spaces within the cell. Each electrode is preferably horizontally disposed within a vertical stack.

Each cathode 50 is supported by a plurality of graphite lateral support pillars (e.g. pillars 60) and central support pillars (e.g. pillars 61). In the direction of the depth of the electrode, there are other pillars behind those shown. These hidden pillars are spaced from those shown and from one another so that bath circulation through sum 26 is possible.

The remaining electrodes are stacked one above the other in a spaced relationship maintained by refractory spacers 53 in the interelectrode spaces and are connected to, and spaced from, the side walls by individual insulating pins 54. These spacers 53 are dimensioned to closely space the electrodes, as for example to space them with their opposed surfaces separated by less than $\frac{3}{4}$ inch.

Above the stacks, hold-down blocks 47 bear on the upper surfaces of the anodes 46 to maintain the stacks in place.

In the illustrated embodiment, 12 interelectrode spaces are formed between opposed electrodes in each stack, one interelectrode space between cathode 50 and the lowest of the bipolar electrodes 10 between successive pairs of intermediate bipolar electrodes and one between the highest of the bipolar electrodes and anode 46. Each interelectrode space is bounded above by an electrode lower surface (which functions as an anodic surface) and below by an electrode upper surface (which functions as a cathodic surface). The spacing therebetween is referred to as the anode-cathode distance (the electrode-to-electrode distance is the effective anode-cathode distance, due to the sweeping action of the bath which removes the aluminum as it is formed. The anodic surfaces may have chlorine removing channels for getting the chlorine rapidly out of the electrolysis effective interelectrode spaces.

The bath level in the cell can vary in operation but normally will lie above the anode 46 to fill all otherwise unoccupied space below within the cell.

Inwards of the outer peripheries of the electrodes, i.e. in this embodiment between the separate stacks of electrodes, is located a gas-lift passage 55 maintained by spacers 57. The widths of the electrodes in the stacks are so chosen that the gas-lift passage 55 has its greatest breadth between the anodes 46, the breadth decreasing down the stacks, with the smallest breadth being between the lowest bipolar electrodes. The gas-lift passage 55 provides for the upward circulation of the bath between the interelectrode spaces inwards of the outer peripheries of the electrodes to the reservoir 34 after passage of the bath through the interelectrode spaces between the electrodes. The flow is induced by the gas-lift effect of the chlorine gas internally produced by electrolysis in the interelectrode spaces.

The above-mentioned chlorine removing channels may be extended right into the passage 55, while being blocked off on their opposite ends. It has been found that this aids in getting the chlorine started in the right direction, i.e. toward, and into, passage 55. Once the chlorine gets started flowing in the desired direction and provided the various flow cross sections in the cell have been properly dimensioned, the chlorine keeps going in that direction. Thus, the blocking-off of one side of the channels is not indispensable. The gas flow can be started in the desired direction by other means, for example by using a mechanical pumping of the bath or by introducing a pulse of gas at the bottom of passage 55. The dimensioning of passage 55 and the remainder of the flow cross sections in any particular cell is advantageously carried out using water modeling techniques.

Upcomer dams 59, located adjacent the exit end of the gas lift passage above the anodes, serve to prevent unwanted rechlorination of the electrolyzed metal. The upper portions of the dams protrude above the upper level of the bath and force the lateral flow of the bath above the electrodes to be through passageways 63 in the direction of arrows C and D. Passageways 63 open on both sides of each dam 59 below the surface of the bath while the bath surface lies below the top of dam 59. The resulting flowpath resists the tendency of pieces of molten matal, which are brought upwards in the passage 55, from breaking the bath surface and getting rechlorinated by the metal-oxidizing chlorine in reservoir 34 above the surface of the bath. It would be best if most of the metal produced on the cathodic surfaces would fall in passage 55 to sump 26 because any metal which is swept upwards can get rechlorinated if it breaks through the upper surface of the bath. This would adversely affect current efficiency. It is to guard against this eventuality that dams 59 are provided. Preferably, the bath flow velocity in the directions of arrows C and D is great enough to perform a sweeping action on the top of anodes 46 in the same manner that the cathodic surfaces in the interelectrode spaces are swept.

Between each electrode stack and the refractory side walls 24, i.e. at the outer peripheries of the electrodes, are two bath supply passages 56 extending past each interelectrode space and past the bipolar electrodes, anode 46 and cathode 50. Each passage 56 is maintained by pins 54, by which there is on each side of the cell a series of aligned gaps between the cell walls and the electrodes, these aligned gaps forming the two passages 56. The movement of bath in the passages 56 is first downwardly past anodes 46, thus passing first into the outside regions of the uppermost interelectrode spaces where portions of the bath split off to supply and sweep the uppermost interelectrode spaces. Focusing on either of the two sides, the remainder of the bath then flows downwardly past the outside of the next electrode to the outside of the next interelectrode space, and so on. A final portion of the bath may flow on through the openings on the outside of the cathodes 50 into, through the sump 26, then up into passage 55. It will thus be seen that passages 56 make it possible for the bath to circulate downwards peripherally of the electrodes, with the motivating circulatory force being created by the gas-lift action in passage 55 inwards of the outer peripheries of the electrodes.

As brought out above, design of the dimensions of the various parts of the gas-lift and bath supply passages can be carried out advantageously using the principles of water modeling to assure that the forming metal is swept out of each interelectrode space without substantial accumulation of the metal on the cathodic surfaces. For the broader aspect of the present invention, however, it is not necessary that the bath sweep velocity be high enough to sweep out metal. It need only be sufficient to prevent exhaustion of the dissolved aluminum chloride at the end of the trip of the bath through the particular interelectrode space under consideration.

The anode has a plurality of electrode bars 58 inserted therein which serve as positive current leads, and the cathode has a plurality of collector bars 62 inserted therein which serve as negative current leads. The bars extend through the cell and cooling jacket walls and are suitably insulated therefrom.

Figure 1:
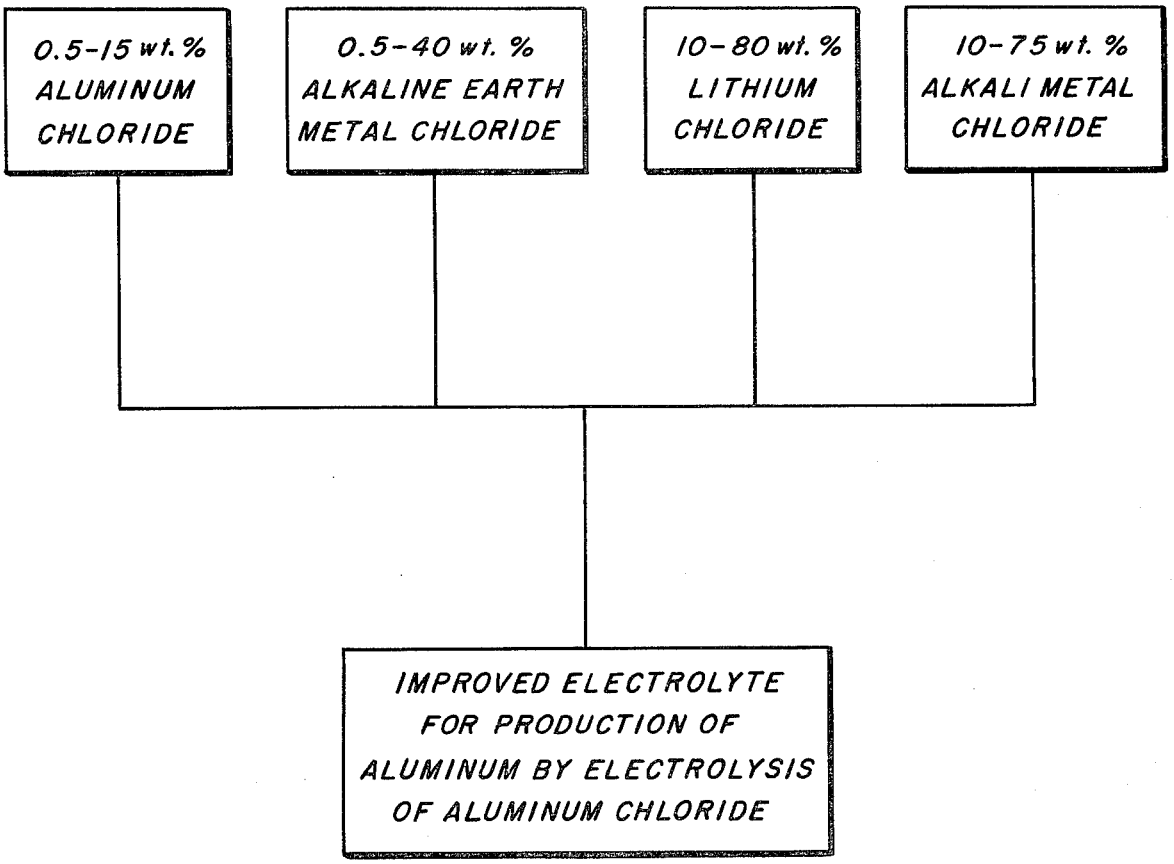
FIG. 1 is a flowsheet illustrating an improved electrolyte for the production of aluminum from aluminum chloride in accordance with the invention.

Referring now to FIG. 1, a bath having improved electrical conductivity when used in a cell of this type, as noted earlier, consists essentially of about 0.5 to 15 wt.% aluminum chloride, from 0.5 to 40 wt.% of an alkaline earth metal chloride selected from the group consisting of calcium chloride, magnesium chloride, barium chloride and strontium chloride, up to 90 wt.% lithium chloride and up to 80 wt.%, e.g. about 10 to 75 wt.%, sodium chloride. With respect to calcium or magnesium chloride, it is preferred that either chlorides or a combination of both be maintained or employed in the range of 0.5 to 11 wt.%, and more preferably, about 2 to 11 wt.%. It is an important feature of this invention that the alkaline earth metal chlorides of the group consisting of calcium, magnesium, barium and strontium be used in these proportions, as will be illustrated hereinbelow. Preferably, the amount of lithium chloride is maintained in the range of 10 to 80 wt.% and typically in the range of 20 to 50 wt.%, and preferably, the amount of sodium chloride employed is in the range of 30 to 70 wt.%. A typical electrolyte bath contains 50 to 60 wt.% sodium chloride, 30 to 40 wt.% lithium chloride, 8 wt.% of at least one of calcium chloride and magnesium chloride and 2 wt.% aluminum chloride.

For purposes of illustrating the effectiveness of the invention, a bath was formulated containing 54 wt.% NaCl, 44 wt.% $CaCl_2$ and about 2 wt.% $AlCl_3$. A bath having this composition was run in a bench-scale electrolysis cell for a period of six hours at 800° C. and for five hours at 750° C. However, the bath of this composition was considered to be unsuitable because its electrical conductivity was only 2.0 $ohm^{-1}$ $cm^{-1}$. That is, the electrical conductivity was about half that which can be achieved in a conventional bipolar electrolysis cell, for example, as illustrated in FIG. 2 where the conventional bath consists of NaCl, LiCl and $AlCl_3$. Thus, it will be appreciated that a bath having such a low conductivity would be unsuitable for commercial operations. However, benefits resulting from this bath include small aluminum droplet size and substantially no refractory and graphite wear at higher than normal operating temperatures. It is believed that these benefits are obtained because of a reduced amount of aluminum dissolved in the bath.

Having a small amount of aluminum dissolved in the bath is important in that dissolved aluminum reacts with $Cl_2$ and reduces current efficiency. Further, the reaction product of dissolved aluminum and $Cl_2$ can react with cell refractories and graphite causing degradation of such materials and producing particulate which is harmful to the cell. With respect to the smaller droplets, they are more easily removed from the cathode surface by the flowing bath. Further, the smaller droplets diminish short-circuiting between anode and cathode.

To illustrate the electrical conductivity of a bath containing large amounts of $CaCl_2$ in accordance with the invention, a second bath was made up and tested. The bath contained 32 wt.% NaCl, 32 wt.% $CaCl_2$, 3 wt.% $AlCl_3$ and 32 wt.% LiCl. In this test, the electrical conductivity of the bath was increased to about 3.2 ohm$-1$ cm$-1$ due to the replacement of NaCl and $CaCl_2$ with LiCl. While this was still about 20% lower than that for a conventional bath without the $CaCl_2$, the benefits of $CaCl_2$ noted in the first bath were maintained and would be effective in offsetting any penalties resulting from lower bath electrical conductivity.

In a further attempt to increase the electrical conductivity, the amount of LiCl was increased. Thus, the bath was changed to a composition consisting of 30.4 wt.% NaCl, 30.4 wt.% $CaCl_2$, 36.5 wt.% LiCl and 2.7 wt.% $AlCl_3$, and after testing, the electrical conductivity was found to be 3.4 ohm$-1$ cm$-1$. It was found that the electrical conductivity was increased slightly; however, it was still lower than that normally found in a commercial bipolar cell.

In order to maintain the benefits of $CaCl_2$, i.e. reduced aluminum solubility, and at the same time minimize its disadvantages, tests were run at very low levels of $CaCl_2$. Thus, a bath was prepared containing 61 wt.% NaCl, 31 wt.% LiCl, 3 wt.% $CaCl_2$ and 5 wt.% $AlCl_3$.

The electrical conductivity of this bath was approximately 3.7 ohm$^{-1}$ cm$^{-1}$ or within 10% of the conventional bath. Electrical conductivities in this range are achievable up to 12% $CaCl_2$, for example. It was also noted that even at low levels, the addition of $CaCl_2$ provided much of the benefits previously discussed but without unacceptable degradation of electrical conductivity or risk of two-phase formation. It is believed that the amount of $CaCl_2$ required to achieve a significant reduction in soluble aluminum is dependent on the concentration of aluminum chloride—the lower the $AlCl_3$ concentration, the less $CaCl_2$ required.

Cells with adequate circulation of electrolyte can operate at low levels of $AlCl_3$ (less than 2.5 wt.%). Increased current efficiency, smaller chiplet size and less refractory deterioration can be obtained with modest additions of $CaCl_2$ and other alkali earth metal chlorides, e.g. $MgCl_2$.

While the invention has been described in terms of preferred embodiments, the claims appended hereto are intended to encompass other embodiments which fall within the spirit of the invention.

What is claimed is:

1. In an improved process for electrolytic production of aluminum by electrolysis of aluminum chloride in a cell, the electrolysis being performed in a metal chloride electrolyte bath characterized by a lower aluminum solubility, the improvement comprising performing the electrolysis in an electrolyte consisting essentially of 0.5 to 15 wt.% aluminum chloride, from 3 to 40 wt.% of an alkaline earth metal chloride selected from the group consisting of barium, calcium, magnesium and strontium chloride, from 10 to 90 wt.% lithium chloride, and from 10 to 80 wt.% sodium chloride.

2. The process of claim 1 wherein said bath contains from 3 to 12 wt.% of said alkaline earth metal chloride.

3. The process of claim 2 wherein said alkaline earth metal chloride contest is from 3 to 7 wt.%.

4. The process of claim 3 wherein said alkaline earth metal chloride is calcium chloride.

5. The process of claim 1 wherein the amount of lithium chloride is from 20 to 50 wt.%.

6. The process of claim 1 wherein said sodium chloride is in the range of from 30 to 70 wt.%.

7. An improved process for the electrolytic production of aluminum from a molten bath, the improvement consisting of an electrolyte consisting essentially of from 0.5 to 15 wt.% aluminum chloride, from 3 to less than 12 wt.% of one or more alkaline earth metal chlorides selected from the class consisting of calcium chloride, magnesium chloride, barium chloride and strontium chloride, from 20 to 50 wt.% lithium chloride and from 30 to 70 wt.% sodium chloride, the electrolyte being further characterized by a low solubility for reduced aluminum and the production of small droplets of aluminum metal during the reduction process.

8. The improved process of claim 7 wherein said alkaline earth metal chloride consists of calcium chloride in an amount in the range of 3 to 11 wt.%.

9. The process of claim 8 wherein said electrolyte consists of 30 to 40 wt.% lithium chloride, 3 to 11 wt.% calcium chloride, 50 to 60 wt.% sodium chloride and less than 4 wt.% aluminum chloride.

10. The process of claim 9 wherein aluminum chloride is less than 2.5 wt.%.

* * * * *